US007565978B2

(12) United States Patent
Han

(10) Patent No.: US 7,565,978 B2
(45) Date of Patent: Jul. 28, 2009

(54) VACUUM PACKAGING BAGS EQUIPPED WITH DEFLATING DEVICE AND DEFLATING CYLINDERS FOR USE THEREOF

(76) Inventor: Ngai Han, Rm. 301, No. 148, Block East, Yu Fu Building, Dong Yuan Road, Fu Tian, Shenzhen, Guangdong (CN) 518030

( * ) Notice: Subject to any disclaimer, the term of this patent is extended or adjusted under 35 U.S.C. 154(b) by 890 days.

(21) Appl. No.: 11/068,842

(22) Filed: Mar. 2, 2005

(65) Prior Publication Data

US 2006/0120632 A1 Jun. 8, 2006

(30) Foreign Application Priority Data

Dec. 3, 2004 (CN) ..... 2004 2 0095963 U

(51) Int. Cl.
*B65D 81/20* (2006.01)

(52) U.S. Cl. ..... 206/524.8; 383/100; 383/103; 137/512.1; 251/82

(58) Field of Classification Search ..... 383/100, 383/103; 137/512.1; 251/82; 141/64; 206/524.8, 206/829
See application file for complete search history.

(56) References Cited

U.S. PATENT DOCUMENTS 3,949,934 A * 4/1976 Goglio ..... 383/103
4,975,028 A * 12/1990 Schultz ..... 417/442
5,332,095 A * 7/1994 Wu ..... 206/524.8
5,450,963 A * 9/1995 Carson ..... 206/524.8
2003/0015452 A1 * 1/2003 Su ..... 206/524.8

FOREIGN PATENT DOCUMENTS

JP 04189752 A * 7/1992

* cited by examiner

*Primary Examiner*—Nathan J Newhouse
*Assistant Examiner*—Jack H Morgan, Jr.
(74) *Attorney, Agent, or Firm*—Venable LLP; Michael A. Sartori; Justine A. Gozzi

(57) ABSTRACT

Disclosed is a vacuum packaging bag. Three edges of the bag are sealed and one edge is equipped with a concave-convex fastener. The bag is equipped with a deflating device. The deflating device consists of a base, a holding washer, a cover, and a sealing washer. The cover and the based are connected through screw threads. The base is placed inside the bag. The screw part of the base penetrates through one side of the bag. The holding washer fastens the film against the base. The sealing washer is placed on a support. The support is placed in the passageway between the base and the outside of the bag. The middle of the cover has a pressure post which is connected to the sealing washer. The middle of the pressure post has an opening to the outside of the bag. A deflating cylinder is used with the deflating device of the bag. The deflating cylinder is a piston cylinder. The front part of the piston rod has two holding boards. Between the holding boards there is a spacer. The backside board has a notch; the back part of the piston rod is connected to a pulling handle. On the front part of the cylinder is a convex. A pulling ring is attached to the convex. The vacuum packaging bag of the invention is simple in structure, easy to make, and convenient to use. It ensures the stored goods quality and value.

4 Claims, 6 Drawing Sheets

VACUUM PACKAGING BAGS EQUIPPED WITH DEFLATING DEVICE AND DEFLATING CYLINDERS FOR USE THEREOF

CROSS-REFERENCE TO RELATED APPLICATIONS

This application claims the priority of Chinese Patent Application No. 200420095963.6, filed Dec. 3, 2004, which is hereby incorporated by reference.

FIELD OF THE INVENTION

The invention relates to vacuum packaging. Particularly, the invention relates to vacuum packaging bags for food, medicine, camera, textile and electronic parts etc. The vacuum packaging bag of the invention is equipped with a deflating device. The invention also relates to a deflating cylinder which is used with the deflating device.

BACKGROUND OF THE INVENTION

The currently used vacuum packaging bags for food, medicine, and textile products are made from plastic films. After the goods are placed in the bag, the bag is then sucked out of air by vacuum and sealed. One problem the current technology has is that the vacuum pump is too burdensome to carry around. Also, vacuum pumps are expensive, which deprives the vacuum packaging from household uses. Moreover, the current vacuum packaging bags are not suitable for outdoor or field operations. An example of such a time is when gathering samples or specimens where electricity required for the operation of the vacuum pump is unavailable.

SUMMARY OF THE INVENTION

The invention provides a vacuum packaging bag which is equipped with a deflating device and a deflating cylinder. The vacuum packaging bag of the invention can be conveniently carried around and used anytime and anywhere.

The vacuum packaging bag of the invention is a plastic bag. Three edges of the bag are sealed and one edge is equipped with a concave-convex fastener. The center of the bag is equipped with a deflating device. The deflating device consists of a base, a holding washer, a cover, and a sealing washer. A screw thread connects the cover and the base. The base is placed inside the bag. The screw part of the base penetrates through one side of the bag. The holding washer fastens the film against the base. The sealing washer is placed on a support. The support is placed in the passageway between the base and the outside of the bag. The middle of the cover has a pressure post which is connected to the sealing washer. The middle of the pressure post has an opening to the outside of the bag.

The invention includes a deflating cylinder which is used with the deflating device of the bag. The deflating cylinder is a piston cylinder. The front part of the piston rod has two holding boards. Between the holding boards there is a spacer. The backside board has a notch; the back part of the piston rod is connected to a pulling handle. On the front part of the cylinder is a convex surface. A pulling ring is placed around on the convex surface. The outer surface of the front part of the cylinder has screw threads. Through a screw the piston rod and the handle are connected.

The advantages of the invention include:

1) The vacuum packaging bag of the invention uses a deflating cylinder which is small and, unlike the vacuum pump which is used for the known vacuum packaging, does not use electricity.

2) The vacuum packaging bag has a simple structure, it is easy to produce, and convenient to use. If desired, it can be reused.

3) The experimental results have showed that the textiles stored in the bag can be disinfected, damp, and mold proof. The food stored in the bag can be protected from insects, molds, and aspergillums.

DETAILED DESCRIPTION OF THE INVENTION

The vacuum packaging bag of the invention is a plastic bag. Three edges of the bag are sealed and one edge is equipped with a concave-convex fastener. The center of the bag is equipped with a deflating device. The deflating device consists of a base, a holding washer, a cover, and a sealing washer. The cover and the base are connected through screw thread. The base is placed inside the bag. The screw part of the base penetrates through one side of the bag. The holding washer fastens the film against the base. The sealing washer is placed on a support. The support is placed in the passageway between the base and the outside of the bag. The middle of the cover has a pressure post which is connected to the sealing washer. The middle of the pressure post has an opening the outside of the bag.

The invention includes a deflating cylinder which is used with the deflating device of the bag. The deflating cylinder is a piston cylinder. The front part of the piston rod has two holding boards. Between the holding boards there is a spacer. The backside board has a notch; the back part of the piston rod is connected to a pulling handle. On the front part of the cylinder is a convex. A pulling ring is attached to the convex. The outer surface of the front part of the cylinder has screw threads. The piston rod and the handle are connected through screw.

The following examples merely illustrate the invention. Those skilled in the art will recognize many variations that are within the spirit of the invention and scope of the claims.

EXAMPLE 1

Figure 1:
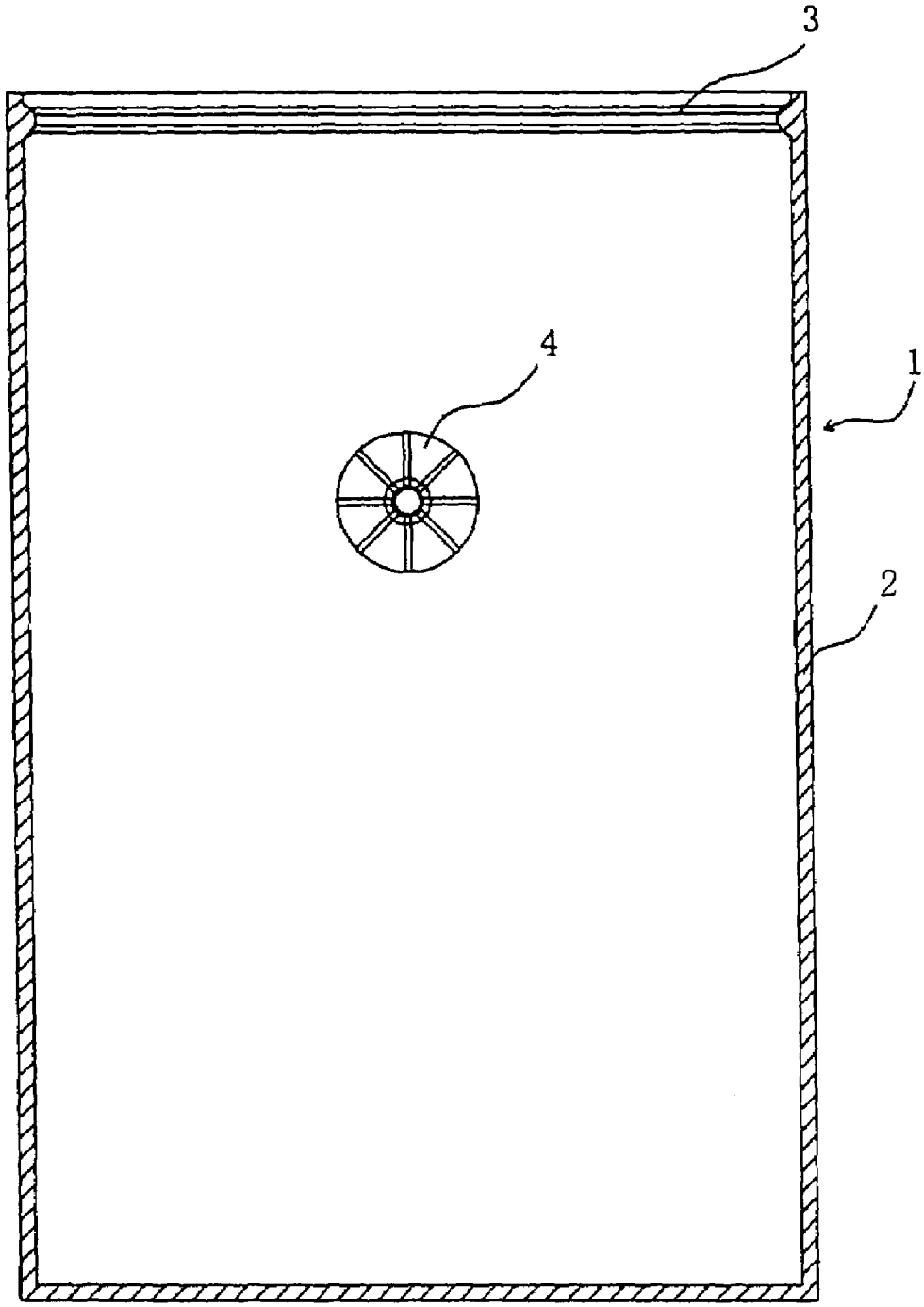
FIG. 1 is a front view of the vacuum packaging bag of the invention.
Figure 2:
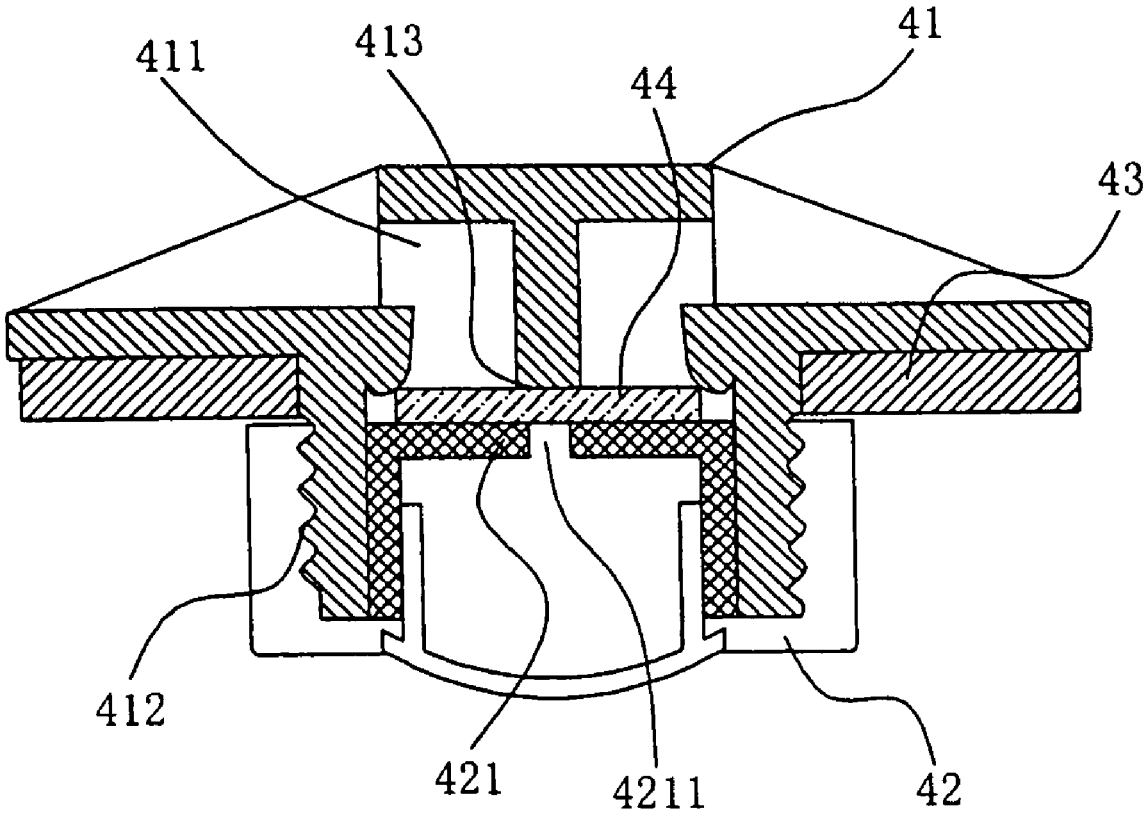
FIG. 2 is a sectional view of the deflating device.
Figure 3:
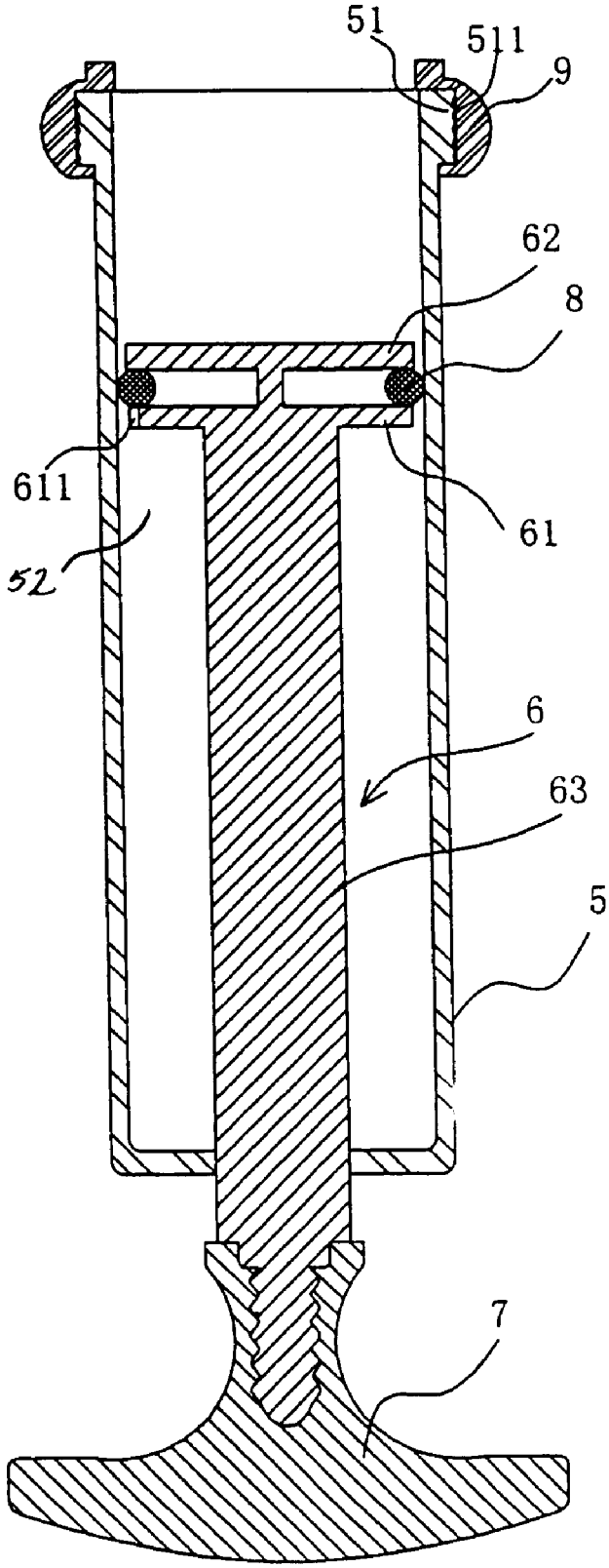
FIG. 3 is a sectional view of the deflating cylinder.
Figure 4:
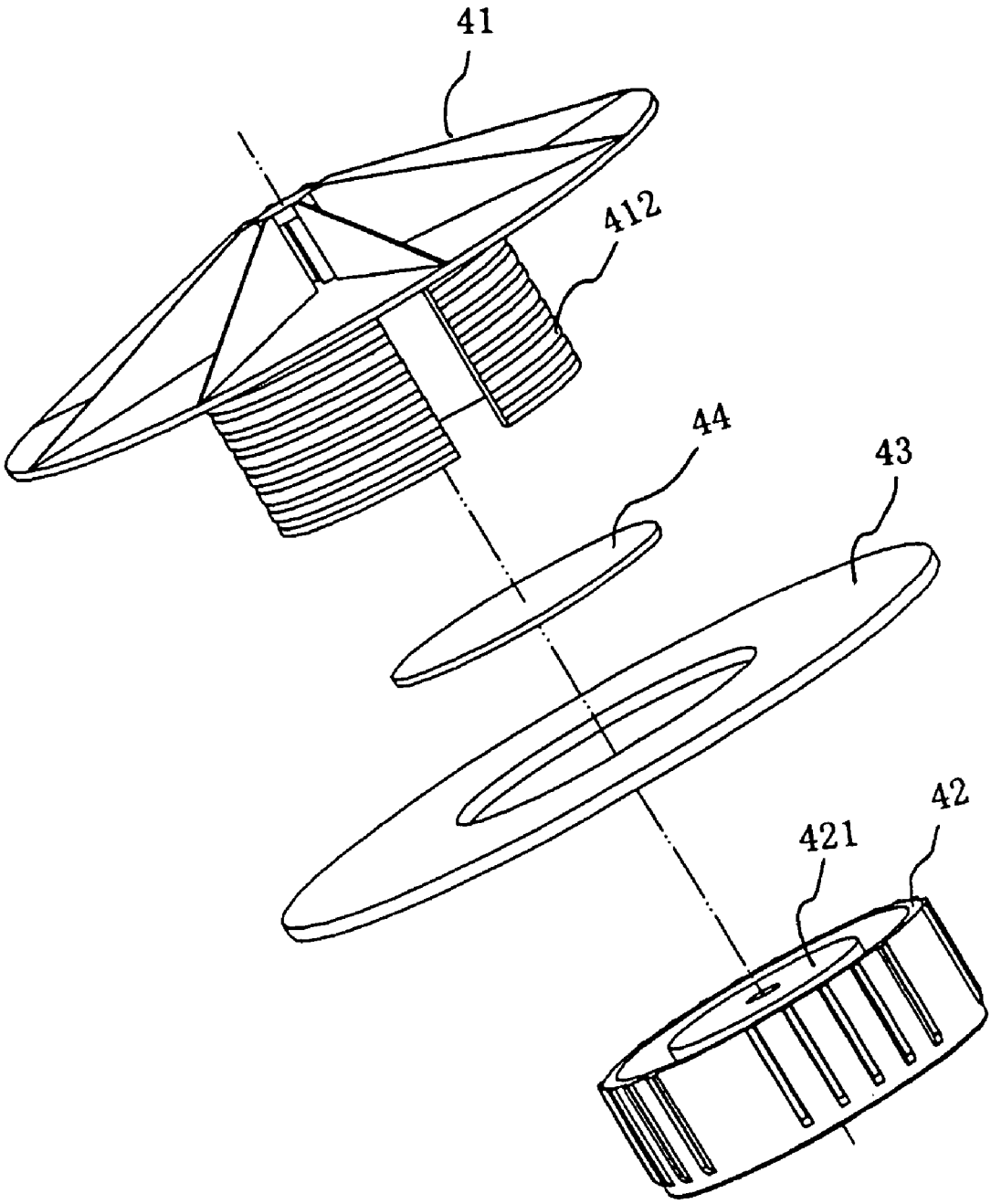
FIG. 4 is a three-dimensional view of the assembling parts of the deflating device.
Figure 5:
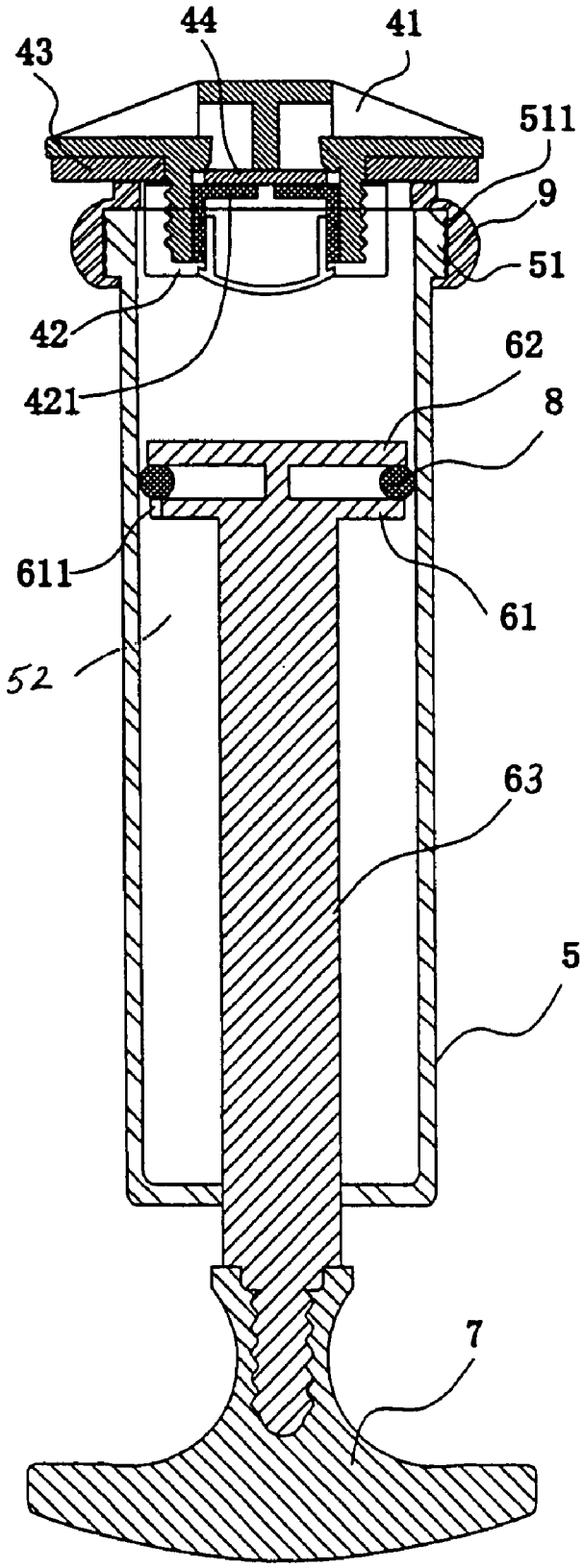
FIG. 5 is a sectional view of the working mechanism of the deflating device and the deflating cylinder.
Figure 6:
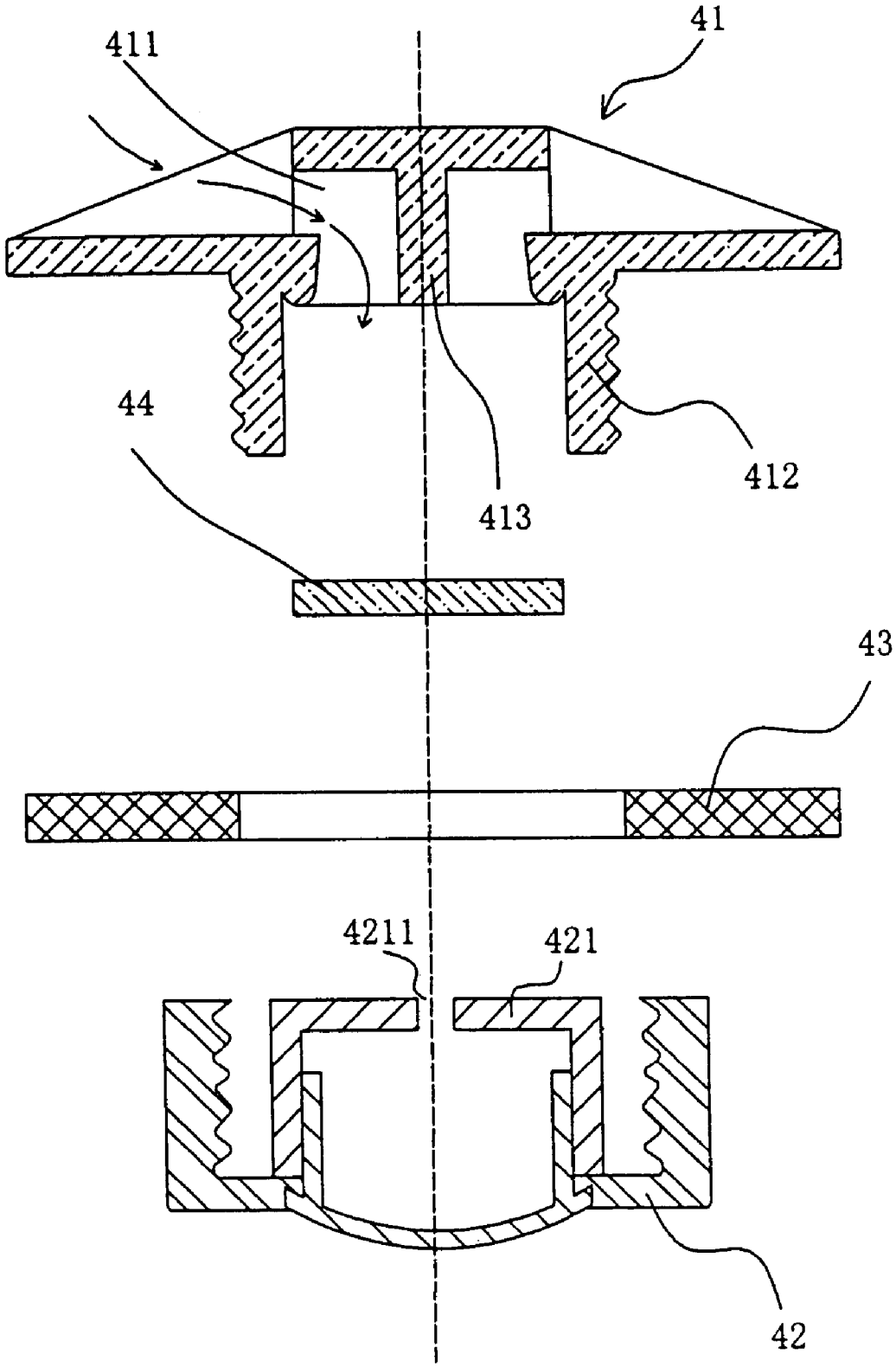
FIG. 6 is a sectional view of the assembling parts of the deflating device.

An example of the vacuum packaging bag of the invention is shown in FIGS. 1-4. The bag body 1 is made from plastic film. The bag body 1 has three sealed edges 2. One edge of the bag body is equipped with a concave-convex fastener 3. On the center of the bag body 1 is equipped a deflating device 4. The deflating device 4 consists of a base 41, a holding washer 43, a cover 42, and a sealing washer 44. The cover 42 and the base 41 are connected through screw threads. The main part of the base 41 is placed inside the bag body 1; the screw part 412, having screw threads, penetrates through one side of the bag body 1. The holding washer 42 is placed around the screw part 412 of the base 41 and fastens the plastic film of the bag body 1 against the base 41. The sealing washer 44 is placed on a support 413. The support 413 is placed on the air passageway between the base 41 and the outside of the bag. In the middle of the cover 42, there is a pressure post 421 which is connected to the sealing washer 44. The sealing washer 44 is made from an elastomer and other parts of the deflating device are made from rigid plastics The deflating cylinder includes the cylinder 5. Inside cylinder 5, there is a piston 6. The piston 6 is connected to a piston rod 63. The front part of the piston rod 63 has two holding boards 61 and 62 and a spacer 8. The spacer 8 is placed between the holding boards 61 and 62. The holding board 61 has a notch 611; the back part of the piston rod 63 is connected on a pulling handle 7. On the front part of the cylinder 5 is a convex surface 51. The pulling ring 9 is attached to the convex surface 51. The outer surface of the convex surface 51 has screw threads 511. The holding board 61 and 62 are made by injection molding with the spacer 8 being held between the holding boards. The piston rod 63 and the pulling handle 7 are connected through screw threads. The pulling ring 9 and the spacer 8 are made from elastomers; the remaining parts of the deflating cylinder are made from rigid plastics.

The working mechanism is as follows. After placing the goods inside the bag 1, fasten the fastener 3. Tighten the cover 42 and press the front part of the deflating cylinder against the holding washer 43. Because the pulling ring 9 is an elastomer, it seals the holding washer 43. Pull the handle 7. Because the sealing washer 44 is an elastomer, it opens under the pulling force. The air in the bag 1 flows, through the base 41 and the cover 42, into the space 52, the front part of the cylinder 5. Push the handle 7 downwards. The downward air and negative pressure formed in the bag 1 cause the sealing washer 44 to block the passageway 411. The holding board 61 of the piston 6 has the notch 611. The spacer 8 is pushed back by the outflow air against the holding board 61, which allows the air in the space 52 of the cylinder 5 to flow out. Repeating these steps, the bag 1 is deflated. Thereafter, tighten the cover 42, causing the pressure post 421 to press onto the sealing washer 44 to prevent the air from flowing back into the bag 1.

EXAMPLE 2

This example differs from Example 1 only in that the middle of the pressure post 421 has an opening 4211. Thus, when the cover 42 is slightly loosened, the air cannot flow through the base 41 and the cover 42, which makes impossible to deflate the bag 1.

I claim:

1. A vacuum packaging bag comprising:

a plastic film bag equipped with a deflating device, the bag having three sealed edges and one open edge with a concave-convex fastener, wherein the deflating device comprises a base, a holding washer, a cover, and a sealing washer; the cover and the base are connected through screw threads; a main part of the base is located inside the bag while a screw part of the base penetrates through one side of the bag; a holding washer holds onto the screw thread of the base and fastens the plastic film of the bag against the base; the sealing washer is placed on a support; the support is placed on an air passageway between the base and an outside of the bag; and in a middle of the cover there is a pressure post which presses on the sealing washer; a deflating cylinder which works with the deflating device; wherein the deflating cylinder comprises a cylinder in which there is a piston; a front part of the piston rod has two holding boards between which there is a spacer; one of the holding boards has a notch; a back part of the piston rod is connected to a pulling handle: on the front part of the cylinder is a convex surface; a pulling ring is attached to the convex surface; and an outer surface of the front part of the cylinder has screw threads.

2. The vacuum packaging bag of claim 1 wherein the pressure post has an opening to the outside of the bag.

3. The vacuum packaging bag of claim 1 wherein the two holding boards are formed by injection molding with the spacer being between the holding boards.

4. The vacuum packaging bag of claim 1 wherein the piston rod and the pulling handle are connected though screw threads.

* * * * *